United States Patent [19]

Remberg

[11] 3,937,589

[45] Feb. 10, 1976

[54] HIGH PRESSURE DOUBLE FLOW TURBINE CONSTRUCTION

[75] Inventor: Axel Remberg, Mulheim, Germany

[73] Assignee: Kraftwerkunion AG, Mulheim (Ruhr), Germany

[22] Filed: Nov. 4, 1974

[21] Appl. No.: 520,866

Related U.S. Application Data

[63] Continuation of Ser. No. 363,124, May 23, 1973, abandoned.

[52] U.S. Cl. ..... 415/101; 415/219 R

[51] Int. Cl.[2] ..... F01D 3/02; F01D 25/24

[58] Field of Search ..... 415/95, 101, 103, 219, 415/108, 138, 135, 136, 137

[56] References Cited

UNITED STATES PATENTS

| | | | |
|---|---|---|---|
| 3,738,770 | 6/1973 | Bolter | 415/101 |
| 3,754,836 | 8/1973 | Bolter | 415/101 |

FOREIGN PATENTS OR APPLICATIONS

| | | | |
|---|---|---|---|
| 337,062 | 10/1930 | United Kingdom | 415/103 |
| 1,108,237 | 6/1961 | Germany | 415/108 |
| 535,854 | 11/1955 | Italy | 415/219 R |

*Primary Examiner*—C. J. Husar
*Assistant Examiner*—L. J. Casaregola
*Attorney, Agent, or Firm*—Herbert L. Lerner

[57] ABSTRACT

A multi-shell high pressure split turbine of double flow construction having an outer shell and an axially split inner shell. The outer shell forms the outer housing. One side of this housing is detachable and joined to the remainder of the housing at a joint in a plane normal to the axis so that the inner shell and the rotor may be inserted from that side.

2 Claims, 7 Drawing Figures

Figure 1:
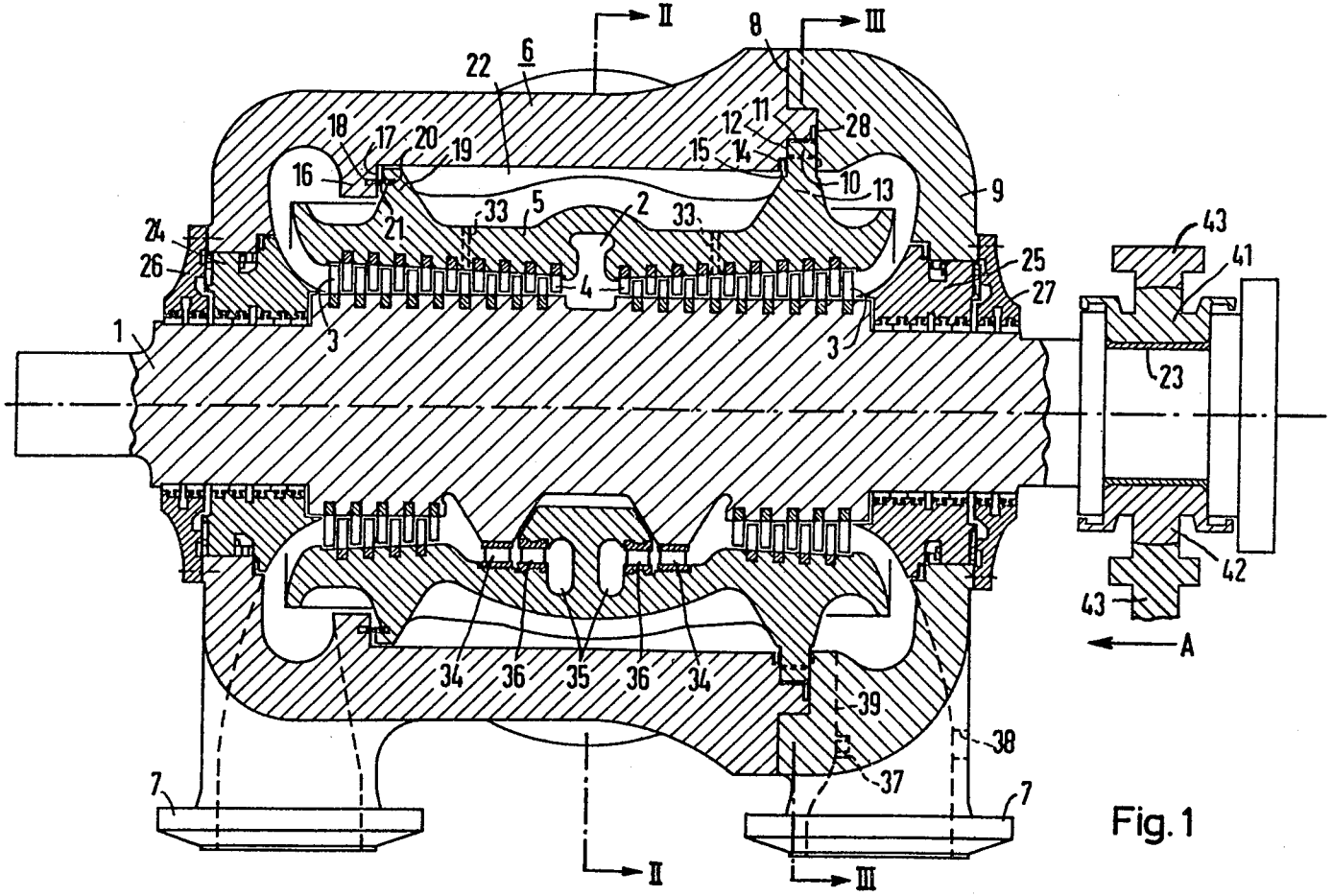

29
29'
30
22
2
22
31
5'
5"
3
32
1
37
5"
31
29
36
30
35
37
37
7
7

HIGH PRESSURE DOUBLE FLOW TURBINE CONSTRUCTION

This is a continuation of application Ser. No. 363,124, filed May 23, 1973 now abandoned.

BACKGROUND

The invention relates to multi-shell split turbines of double flow construction having an outer shell and axially split inner shell which has the blades of both flows as well as the inlet channels for the live steam.

Such turbines are shown in German Utility Model Pat. Nos. 1,701,464 and 1,710,633. The outer shells of the high pressure split turbines shown there are formed as cylindrical central members with the steam inlets and flanged exhaust members flanged on both sides along joints normal to the axis. The inner housing surrounding both flows is there in one piece held axially and radially in mountings in the exhaust members on both sides. Such an arrangement requires, however, considerable outlay of labor for final assembly. Such constructions are moreover not sufficiently rugged for high pressure split turbines with outputs over 1000 MW.

Single flow high pressure split turbines are known (German Pat. No. 1,812,493) which use a housing as the outer shell and which satisfy ruggedness requirements better and which have joints normal to the axis in the exhaust area. But these constructions also require a plurality of attachment and centering elements in order to fix the inner shell precisely in operation so that here, too, outlay of labor for assembly is very great.

SUMMARY OF THE INVENTION

In view of the foregoing, the invention has the general object of providing a multi-shell pressure split turbine whose outer shell satisfies all ruggedness requirements and whose inner shell is mounted simply and securely in the outer shell with the smallest possible use of attachment and centering devices.

With the invention, the outer shell is formed as a housing and has a detachable exhaust portion as part of the housing on one exhaust side connected to the remainder of the housing by a joint normal to the axis so that the inner shell may be inserted into the housing from the side of the detachable exhaust portion. With this construction, for the first time, there is the advantage that the known housing may also be used for double flow constructions of high pressure split turbines.

In this, the inner shell is supported and axially movable on an inwardly projecting shoulder of the housing at its inner exhaust end near the fixed exhaust portion of the housing, and at its outer exhaust end in the region of the normal-to-axis joint of the housing it is secured and fixed axially and radially by the detachable exhaust portion of the housing. Studs on the inner shell there engage axial slots in the shoulders of the housing. With this construction, the inner shell needs to be secured to the housing at only one end.

The inner exhaust end of the inner shell is held and sealed with a cylindrical I ring in coaxial slots in the housing and inner shell. For sealing between the radial studs and the normal-to-axis support surface on the housing, and elastic U ring is used in the joint.

Since with this arrangement of the sealing rings there are no variable steam forces in the axial direction, dimensioning of the supports is relatively small. Further, by securing only on one side of the turbine, thermal expansions of the inner shell and rotor are in the same direction, so that only a small axial play is required.

Self-evidently it is possible to build the inner shell as an inner housing with pressure tight steam inlets and discharge bores to the annular space between outer and inner housings as in blade carrier constructions with unreduced inlet steam pressure in this annular space.

With nozzle regulation with an equal pressure regulation stage, the inner shell itself is provided with the nozzle assemblies and steam inlet canals from the steam inlets which are connected with the inner housing in steam tight relation. In the described construction, the split joint screws of the housing are introduced from a front side, whereby these split joint screws in the region of the exhaust members may be introduced through closable bores in the outer front side, and the screw heads in the inside of the exhaust members are in the inner wall.

THE DRAWINGS

The construction and mode of operation of an embodiment of the invention are explained further with reference to the accompanying drawings, in which:

FIG. 1 is a lengthwise cross section through a turbine with throttle regulated construction in the upper half and nozzle regulated construction in the lower half.

Figures 2A, 2B, 2C, 2D:
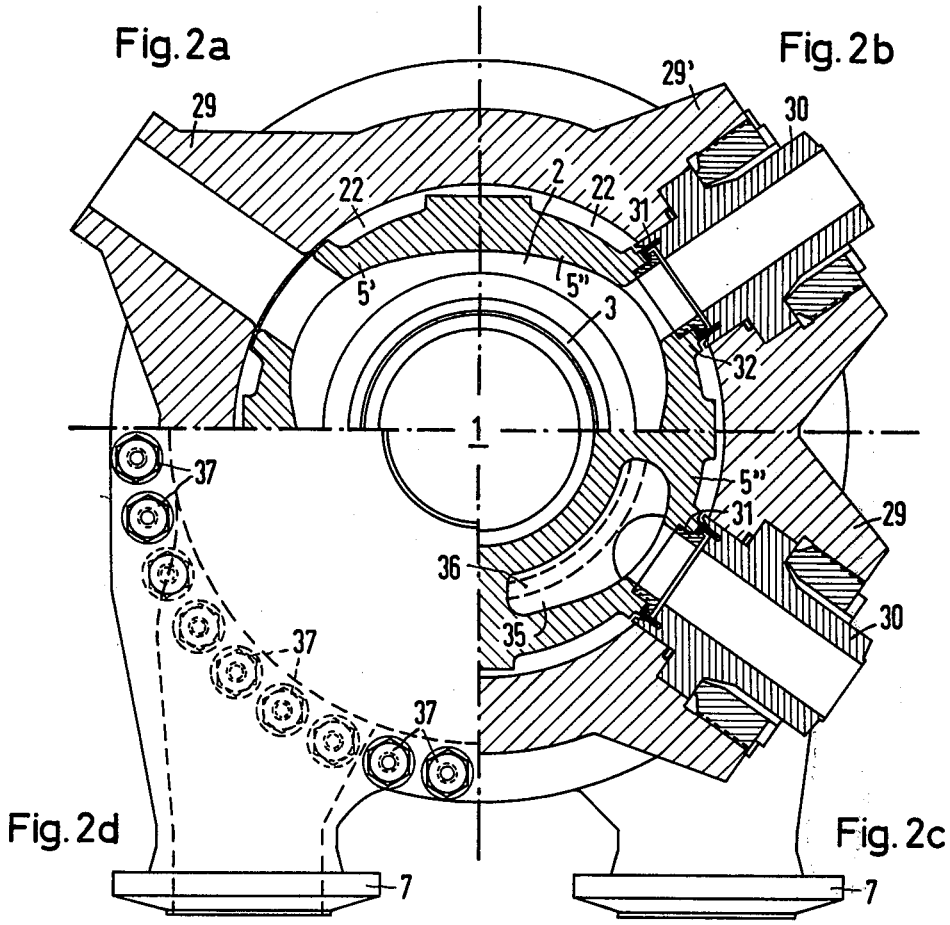

FIGS. 2*a* to 2*d* are partial cross sections corresponding to the section line II—II of FIG. 1. FIG. 2*a* shows a sector section showing the inner shell with blade construction. FIG. 2*b* shows the inner shell as an inner housing with steam tight steam inlets. FIG. 2*c* shows an inner housing with nozzle regulation. FIG. 2*d* shows a sector view of the front side of the turbine as seen from arrow A of FIG. 1.

Figure 3:
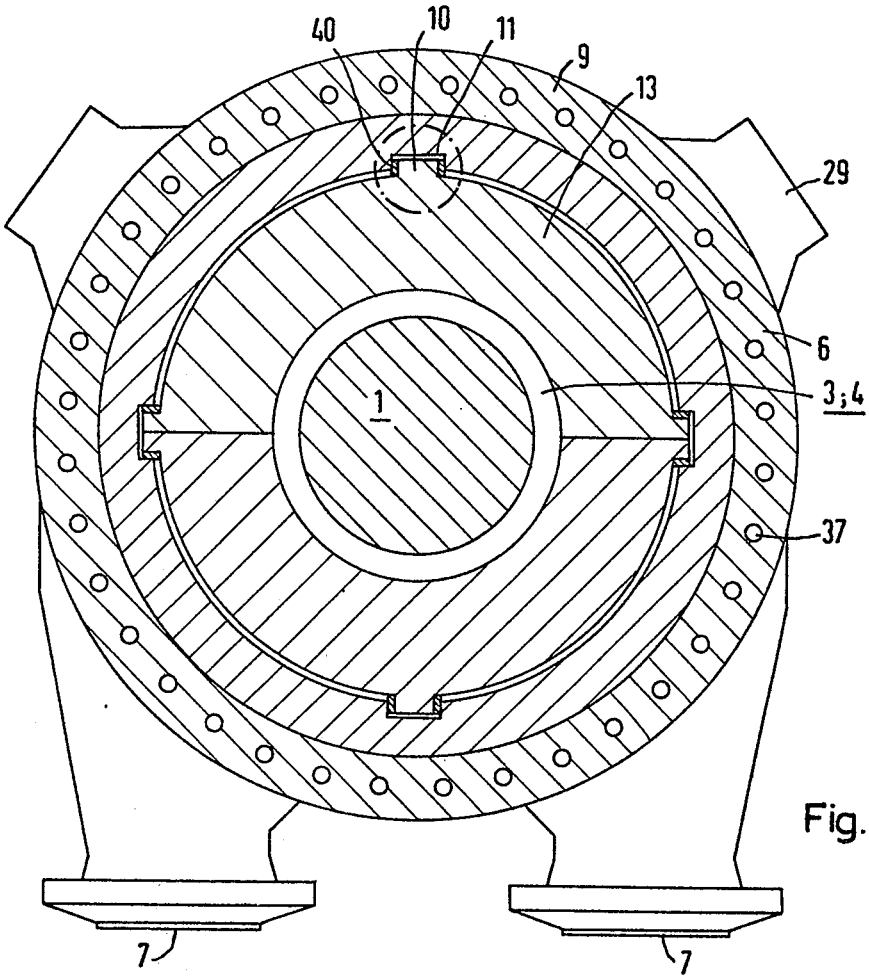
Figure 3A:
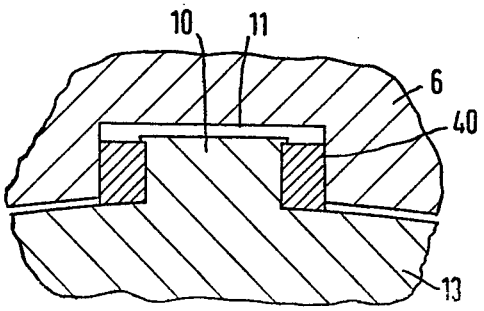

FIG. 3 is a sectional view of FIG. 1. FIG. 3*a* is a detailed view of FIG. 3.

PREFERRED EMBODIMENT

Shaft 1 of the illustrated double flow high pressure split turbine is provided with an axial row of circumferential blades 3, on both sides of the central circumferential channel 2 for live steam delivery. Between blades 3 is arranged the similarly axial row of circumferential blades 4 on the inner shell 5. Therefore the upper half of FIG. 1 illustrates a throttle regulated machine.

In accordance with the invention, the outer shell of the turbine is housing 6 and has at both exhaust ends one or two exhausts 7. The housing 6 is divided by a joint 8 normal to the axis and is thereby divided so that an exhaust portion 9 of housing 6 on one exhaust side of the housing 6 can be detachably screwed to the remainder of housing 6. Through the opening, when portion 9 is detached, the shaft 1 with its blades, as well as the inner shell or inner housing 5, may be inserted into the outer shell or housing 6.

This arrangement offers the special advantage in the suspension and support of the inner shell 5 in housing 6. The inner shell 5 has on its outer end, that is to say, its exhaust side on the side of the detachable exhaust portion 9, several equally peripherally spaced studs 10 which engage corresponding axial slots 11 in the region of the joints 8. These studs 10 are supported on corresponding normal-to-axis shoulders 12 of housing 6. Inner shell 5 is fixed and held axially and radially by being braced by screwing of detachable exhaust part 9 which functions as a support ring for the inner shell 5. Additionally there is between the extension 13 of inner shell 5, which extension carries studs 10, and normal-to-axis surface 14 of the housing 6, an elastic U shaped sealing ring 15. Exhaust portion 9 is also sealed off with a U ring 28 in the region of joint 8.

On its inner end, housing 6 has an inwardly projecting shoulder 16 at a smaller diameter than shoulders 12 near joint 8. In the radial bearing surface 17 of shoulder 16, there is a ring slot 18. The inner shell 5 has circumferentially a radial extension 19 whose normal-to-axis exhaust side surface is also provided with a ring slot 20. In both ring slots 18 and 20 there is a cylindrical I shaped sealing ring 21 which permits an axial extension of inner shell 5 in the direction of the left exhaust side and radial extension of the inner shell, and essentially provides sealing of the annular space 22 between inner shell 5 and housing 6 from the exhaust region.

The mounting in the region of joint 8 therefore forms the fixed point for the axial expansion of the inner shell 5. Since the shaft 1 has its fixed point in journal 23 as a support, the inner shell 5 and the shaft 1 expand in the same direction. This construction therefore has a small axial play between both parts, which considerably minimizes construction.

In the outer sides of housing 6, shaft sealing members 24 and 25 are provided in conventional manner, and sealing covers 26 and 27 are screwed on.

FIG. 1 also shows the journal 23 mounted in bearing cups 41 and 42, which are held in bearing block 43.

In FIGS. 2*a* to 2*c* , the input stream regions for various constructions are shown in sector cross section corresponding to section line II—II of FIG. 1. According to FIG. 2*a*, the inner shell 5 is illustrated by blade carrying construction 5', that is to say, the steam inlet members 29 are not directly connected with blade carrier 5', so that in the annular space 22 live steam pressure prevails. Such a construction is useful at low live steam pressures up to about 220 atmospheres.

According to FIG. 2b the inner shell serves the function of an inner housing 5'', since the live steam inlet insert members 30 in the steam inlet 29' lead directly to the inlet member 32 of inner housing 5'' by way of conventional sealing ring connections 31. For pressure relief therefore, as is to be seen from FIG. 1, the relief bores 33 in inner housing 5 are provided, so that annular space 22 is held to a predetermined differential pressure.

In FIG. 2c, which corresponds to the cross section through the lower part of FIG. 1, the turbine is shown as a nozzle regulated machine with an equal pressure regulated stage. The live steam insert 30 is, in the same manner as FIG. 2b, directly connected with inner housing 5'' by a conventional angle ring connection. In that way no special nozzle inserts need be provided; rather, the steam inlet channel 35 and the nozzle member 36 are directly led into the inner housing 5''.

While screwing on the detachable exhaust portion 9, it is preferable to work the flange screws 37 from the outside, as shown in the side view of FIG. 2d corresponding to arrow A of FIG. 1. In the region of exhaust member 7, the screws 37 can be inserted and screwed in through bores 38 in the outer wall of exhaust member 7. The bores 38 may be closed later. The screw heads then lie against inner wall 39 of exhaust member 37.

FIG. 3 shows a sectional view of FIG. 1 illustrating the coaction of the spaced studs 10 in the slots 11.

FIG. 3*a* is a detailed view of the portion of FIG. 3 enclosed in the dash-dotted circle showing the studs 10 and the slot 11 with spacer 40.

With the high pressure split turbine construction described above, the support and fixing of position of the inner shell is simple. It is also possible, with double flow construction of the high pressure parts, to use a housing which meets substantially higher ruggedness requirements than conventional welded housings and housings made of many divided parts.

I claim:

1. A multi-shell split turbine for use at high pressure and high temperature, with double flow construction, having an outer shell, an inner shell split only in an axial plane and carrying blades for both flows, said turbine being provided with inlet channels for live steam, said outer shell being constructed as a barrel-shaped housing having on its outlet side a normal-to-axis joint, an exhaust part provided with exhaust nozzles connected to said outer shell at said joint, said inner shell having in the vicinity of the normal-to-axis joint, a first shoulder provided with radially projecting studs which engage axial slots on a shoulder of the barrel-shaped housing of the outer shell at said joint, in a manner whereby following the mounting and bolting of the exhaust part, the inner shell is radially held and axially braced and fixed, the inner shell having on the other interior end of the barrel-shaped housing from said joint a shoulder on said inner shell positioned opposite an inwardly extending shoulder of the barrel-shaped housing, both shoulders being axially opposed, coaxial slots in both said shoulders, and an I-ring inserted into said slots for a pressure tight but axially movable support of the inner shell.

2. Multi-shell turbine with double-flow construction, designed for high steam pressure and high steam temperatures, having an outer housing and an inner shell which is split only in one axial plane, said inner shell carrying the vane rings of both flows and comprising the inlet channels for the fresh steam, wherein the outer housing is of generally cylindrical shape and has an open end, a closed end, and a cover segment with exhaust member, said cover segment closing said open end and defining therewith a normal-to-axis joint, the outer diameter of said outer housing being proportionally greater in the vicinity of said open end and cover segment than in the vicinity of said closed end, the inner shell in the vicinity of the normal-to-axis joint having radially outwardly extending extension studs projecting radially at the outer periphery of said extension, said studs fitting in axial grooves on a shoulder of said outer housing to engage the partitions which define the front surface of the outer housing, whereby the inner shell is radially held and axially mounted and fixed solely through the studs, after the housing segment has been mounted and bolted.

* * * * *